US012385483B2

(12) United States Patent
Triebe et al.

(10) Patent No.: US 12,385,483 B2
(45) Date of Patent: Aug. 12, 2025

(54) GEAR PUMP WITH INTERMESHING GEARWHEELS ENCLOSED BY HOUSING WITH BEARING JOURNALS ARRANGED ON SHAFT AXES

(71) Applicant: MAAG PUMP SYSTEMS AG, Oberglatt (CH)

(72) Inventors: René Triebe, Schwerzenbach (CH); Hendrik Brands, Würenlos (CH); Markus Steinmann, Zurich (CH)

(73) Assignee: MAAG PUMP SYSTEMS AG, Oberglatt (CH)

( * ) Notice: Subject to any disclaimer, the term of this patent is extended or adjusted under 35 U.S.C. 154(b) by 0 days.

(21) Appl. No.: 18/623,314

(22) Filed: Apr. 1, 2024

(65) Prior Publication Data

US 2024/0352934 A1 Oct. 24, 2024

(30) Foreign Application Priority Data

Apr. 20, 2023 (EP) ..... 23168853

(51) Int. Cl.
*F04C 13/00* (2006.01)
*F01C 21/04* (2006.01)
(Continued)

(52) U.S. Cl.
CPC ..... *F04C 15/0088* (2013.01); *F01C 21/04* (2013.01); *F04C 2/084* (2013.01);
(Continued)

(58) Field of Classification Search
CPC ..... F04C 13/002; F04C 15/0088; F04C 2/18; F01C 21/04; F01C 21/02; F16C 33/1065
See application file for complete search history.

(56) References Cited

U.S. PATENT DOCUMENTS 3,453,031 A 7/1969 Rickley et al.
5,641,281 A 6/1997 Russell et al.
2014/0341767 A1 11/2014 Crotti et al.

FOREIGN PATENT DOCUMENTS

DE 42 04 157 A1 8/1993
DE 102012216256 A1 * 3/2014 ..... F01C 21/02
(Continued)

OTHER PUBLICATIONS

English EP2672119 by PE2E Jul. 24, 2024.*
(Continued)

*Primary Examiner* — Deming Wan
(74) *Attorney, Agent, or Firm* — Procopio, Cory, Hargreaves & Savitch LLP

(57) ABSTRACT

Gear pump with intermeshing gearwheels enclosed by a housing with bearing journals on shaft axes projecting laterally from the gear wheels mounted in the housing by slide bearings each having a slide bearing length, each having a lubrication pocket with radial expansion. The lubrication pocket is spaced from a gear-side end face of the respective slide bearing by a first distance, having a first bar with a first bar width with axial expansion corresponding to a slide bearing surface. The lubrication pocket is spaced apart by a second distance from the bearing end face opposite the gear end face. A second bar with a second bar width with axial extension corresponds to a slide bearing surface, a bore leads through the slide bearing and communicates with the lubrication pocket at an injection point. The bore is operatively connected to a conveying device for conveying lubricating medium into the lubrication pocket.

13 Claims, 3 Drawing Sheets

(51) Int. Cl.

| | |
|---|---|
| ***F04C 2/08*** | (2006.01) |
| ***F04C 2/18*** | (2006.01) |
| ***F04C 15/00*** | (2006.01) |
| ***F16C 33/10*** | (2006.01) |

(52) U.S. Cl.
CPC ..... *F04C 13/002* (2013.01); *F04C 2240/30* (2013.01); *F04C 2240/50* (2013.01)

(56) References Cited

FOREIGN PATENT DOCUMENTS

| | | | | |
|---|---|---|---|---|
| EP | 2672119 | A1 * | 12/2013 | ..... F04C 15/0088 |
| EP | 4 083 428 | A1 | 11/2022 | |

OTHER PUBLICATIONS

English translation of DE 102012216256 by PE2E.*
Search Report received in corresponding European Application No. 23168853.2, dated Sep. 21, 2023, in 2 pages.
Extended European Search Report, with translation, received in corresponding European Application No. 23168853.2, dated Oct. 2, 2023, in 18 pages.

* cited by examiner

GEAR PUMP WITH INTERMESHING GEARWHEELS ENCLOSED BY HOUSING WITH BEARING JOURNALS ARRANGED ON SHAFT AXES

TECHNICAL FIELD

The present invention relates to a gear pump and to a use of the gear pump.

STATE OF THE ART

Gear pumps essentially consist of a pair of intermeshing gear wheels, which are enclosed in a housing and from which bearing journals arranged laterally around the longitudinal axis protrude, which are in slide bearings lubricated with the pumped medium.

As gear pumps have a rigid characteristic curve, they are particularly suitable for transporting pumped media from a suction side to a pressure side. A pressure gradient is created between the two latter sides due to the pumped volume flow in the downstream units, which is particularly large with highly viscous media and leads to a transmission of force to each gear wheel.

A known gear pump is described, for example, in EP-1 790 854 A1, which is a gear pump in which a bearing journal diameter is almost or equal to a root diameter of the toothing.

The known gear pumps have slide bearings that are lubricated with the pumped medium. There is high pressure on one side of the slide bearings on the gear pump outlet side, whereas the pressure behind the slide bearing is approximately equal to the one on the suction side of the gear pump, which is significantly lower than the pressure on the pump outlet side. Due to this pressure difference, pumped medium, which is required to build up the lubricating film in the slide bearing, flows from the pump outlet into the slide bearing. A pressure lubrication groove in the face of the slide bearing forms a direct connection from the outlet side to the slide bearing in order to supply the lubrication groove in the slide bearing as well as possible with pumped medium.

If a polymer melt is used as the conveying medium, which also contains a high proportion of solids or solids above a critical size (generally referred to as foreign particles), this poses a problem for sufficient lubrication in the slide bearing. For the slide bearings to function properly, it is important to build up a lubricating film of pumped medium. If too many or too large foreign particles get into the narrow lubrication gap between the shaft and the slide bearing, there is a risk of damage to the slide bearing or the shaft, which can lead to failure of the gear pump. This is particularly the case if the particle size is larger than the height of the minimum lubricant film, as this leads to an interruption of the lubricant flow due to blockage in the slide bearing and thus to a failure of the gear pump. If too little melt enters the slide bearing, there is a risk of insufficient lubrication. An increased flow of melt (pumped medium) comprising particles can also lead to increased abrasive wear of the slide bearing surfaces.

Furthermore, if a polymer is used as the pumped medium, unmelted polymer particles (small lumps) that enter the slide bearing via the lubrication groove can block the lubrication flow and cause the gear pump to fail.

The problem of foreign particles can be tackled within certain limits by using a slide bearing with filling pockets, as described, for example, in EP 4 083 428 A1. The filling pocket incorporated into the slide bearing is characterized by a bar between the end face of the slide bearing on the gear wheel side and the filling pocket, whereby the bar prevents large foreign particles in the pumped medium from entering the lubrication gap between the gear wheel shaft and the slide bearing. For many applications, this approach already offers a good solution for "filtering out" solids from the main flow before the filtered medium enters the slide bearing to build up the lubricating film.

However, with polymer melts as the pumped medium with low viscosity, which can only form a thin lubricating film in the slide bearing, this known method of filtering the pumped medium is not sufficient. Too many foreign substances still get into the lubrication gap and the risk of damage (so-called seizure) increases.

SUMMARY OF THE INVENTION

It is therefore a task of the present invention to provide an improved gear pump which is considerably more robust in operation than known solutions.

This task is solved by the features specified in the characterizing part of claim 1. Further embodiments of the present invention and a use are defined in further claims.

A gear pump according to the invention comprises intermeshing gear wheels enclosed by a housing with bearing journals arranged on shaft axes and each projecting laterally from the gear wheels, which are mounted in the housing by means of slide bearings each having a slide bearing length, which each have a lubrication pocket with radial extension, the lubrication pocket being spaced from a gear-side end face of the respective slide bearing by a first distance, so that a first bar with a first bar width with axial extension corresponding to a slide bearing surface is present. The invention is characterized in

- that the lubrication pocket is also spaced apart by a second distance from the bearing end face opposite the gear end face, so that a second bar with a second bar width with axial expansion corresponding to a slide bearing surface is present,
- that a bore leads through the slide bearing and communicates with the lubrication pocket at an injection point and
- that the bore is operatively connected to a conveying device for conveying lubricant into the lubrication pocket.

The gear pump according to the invention is therefore considerably more robust compared to known gear pumps, as neither unmelted polymer particles (small lumps) nor foreign particles can get into the lubrication groove in the slide bearing when a polymer is used as the pumping medium. This significantly reduces the risk of blockage of the lubricant flow. The lubrication flow is therefore blocked much less, which significantly reduces the probability of failure of the gear pump according to the invention.

One embodiment of the gear pump according to the invention consists in that the first bar width is at least 5% to 20%, preferably 15%, of the slide bearing length.

Further embodiments of the gear pump according to the invention consist in that the second bar width is at least 5% to 15%, preferably 10%, of the slide bearing length.

Still further embodiments of the gear pump according to the invention consist in that the lubrication pocket begins in relation to a plane spanned by the two shaft axes and in the direction of rotation of the gear wheels in an angular range of 210° to 315°, preferably at 270°.

Still further embodiments of the gear pump according to the invention consist in that the lubrication pocket ends at an angle of 300° to 30°, preferably at 355°, in relation to a plane spanned by the two shaft axes and in the direction of rotation of the gear wheels.

Still further embodiments of the gear pump according to the invention consist in that the injection point is being arranged in the center of the lubrication pocket in the axial extension of the lubrication pocket.

Still further embodiments of the gear pump according to the invention consist in that the injection point is arranged in relation to a plane spanned by the two shaft axes and in the direction of rotation of the gear wheels in an angular range of 225° to 315°, preferably in an angular range of 240° to 300°, preferably at 270°.

Still further embodiments of the gear pump according to the invention consist in that the lubrication pocket is deepest in the area of the injection point.

Still further embodiments of the gear pump according to the invention consist in that the injection point, viewed in the direction of rotation of the gears, is arranged at the beginning of the lubrication pocket.

Still further embodiments of the gear pump according to the invention consist in that the lubrication pocket, starting from the injection point and viewed in the direction of rotation of the gear wheels, is wider.

Still further embodiments of the gear pump according to the invention consist in that cross-sectional areas of the lubrication pocket, starting from the injection point and viewed in the direction of rotation of the gear wheels, are the same size over ⅔ of their unwound length and that cross-sectional areas of the lubrication pocket are designed to decrease steadily over the remaining unwound length to the end of the lubrication pocket.

Still further embodiments of the gear pump according to the invention consist in that a cross-sectional area of the bore is the same size as the cross-sectional areas of the lubrication pocket in the first ⅔ of the unwound length of the lubrication pocket.

Still further embodiments of the gear pump according to the invention consist in that the bore is being arranged radially to an outer diameter of the respective slide bearing.

Still further embodiments of the gear pump according to the invention consist in that at least one of the bearing journals has, at least over part of its axial extent, a bearing journal diameter which lies in the range from 90% to 100% of a root circle diameter of the toothing of the associated gearwheel.

Finally, the present invention comprises a use of the gear pump according to one or more of the above-mentioned embodiments for conveying highly viscous conveying media, such as polymer, with a mass percentage of fillers (e.g. titanium dioxide $TiO_2$, calcium carbonate, wood flour, stone, chalk, tallow, talc, silicates, carbons, in particular in the form of carbon black) of more than 60% of the total mass of the conveying medium.

The present invention also includes a use of the gear pump according to one or more of the above-mentioned embodiments for conveying media with low viscosity (greater than or equal to one Pascal second), as well as polymer melts loaded with foreign particles, in which the foreign particles have a size which is equal to or greater than the minimum lubricating film in the slide bearing.

The aforementioned embodiments of the present invention can be combined in any order. Only those combinations of embodiments are excluded which would lead to a contradiction due to the combination.

BRIEF DESCRIPTION OF THE FIGURES

Examples of embodiments of the present invention are explained in more detail below with reference to figures. These are for explanatory purposes only and are not to be construed restrictively. They show.

DETAILED DESCRIPTION OF THE INVENTION

Figure 1:
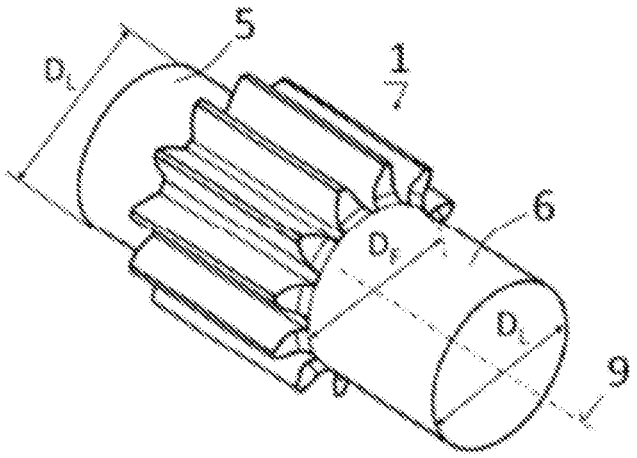
FIG. 1 a perspective view of a known gear wheel with bearing journals for a gear pump according to the invention, FIG. 2 a section through a slide bearing according to the invention parallel to a longitudinal axis of the gear wheel with a view of a bore with a lubrication pocket, FIG. 3 a partial cross-section through the slide bearing according to the invention in the area of the bore, FIG. 4 a section according to FIG. 3 through the slide bearing according to the invention with angles for determining the position of the bore and the lubrication pocket and FIG. 5 a graphical representation of the cross-section of the lubricating pocket according to the invention as a function of an angle of rotation.

FIG. 1 shows a perspective view of a gear wheel 1 known per se with bearing journals 5 and 6 for a gear pump according to the invention. Over part of their axial extension, the bearing journals 5 and 6 have a bearing journal diameter $D_L$ which is approximately as large as a root diameter $D_F$ of the toothing. The bearing journal diameter $D_L$ is at least in the range of 90% to 100% of the root circle diameter $D_F$. Of course, this also applies to the bearing journals of the second gear wheel not shown in FIG. 1. However, it is expressly pointed out that the aforementioned design variant with the bearing journal diameter and root circle diameter defined above does not necessarily have to be realized in this way. A conventional design variant in which the bearing journal diameter is smaller than 90% of the root diameter is also conceivable.

Figure 2:
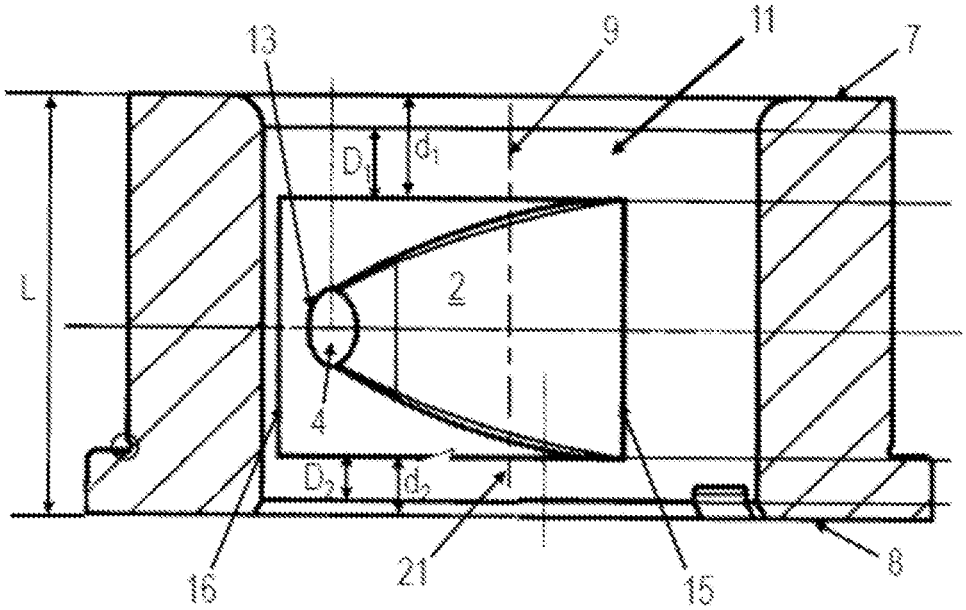

In contrast to the proven principle of bearing lubrication by means of a pumped medium, which is fed into the slide bearings through grooves (see for example EP 833 068 B1), a clean, contaminant-free lubricating medium for lubricating film build-up is now provided by a separate external pumping device and pressed into a lubricating pocket 2 (FIG. 2) in the slide bearing 3 (FIG. 2) via a bore 4 (FIG. 2). In this way, the lubricating film build-up between the slide bearing 3 and the bearing journal 5, 6 is largely independent of the lubricating film-building properties of the pumped medium, as this task is performed by a suitable, clean and largely foreign substance-free lubricating medium. Reference is expressly made to the advantage that this external lubricating medium for lubricating film build-up can be different from the pumped medium to be recycled. It is expressly emphasized that the external lubricant can differ significantly from the pumped medium. Depending on the application data, a suitable external pumped medium (lubricating medium) with specific properties can be selected, in particular due to the fact that only a negligibly small amount is required for the lubrication of the slide bearings.

For example, a lubricant is used that has a viscosity of 1 Pas in the pumpable state.

FIG. 2 shows a cross-section through a slide bearing 3 according to the invention with a slide bearing length L. The cut plane runs parallel to the shaft axis 9 and is positioned so that the lubrication pocket 2 incorporated in the slide bearing 3 is visible.

As can already be seen from FIG. 2, the lubrication pocket 2 is spaced from a gear-side end face 7 (also referred to as the inner side of the bearing) of the slide bearing 3 by a first distance $d_1$, so that a first bar 11 with radial expansion corresponding to the sliding surface of the slide bearing 3 is present. The first bar 11 has a first bar width $D_1$, whereby this is smaller than the first distance $d_1$, because a transition from the sliding surface to the end face of the slide bearing 3 is not part of the first bar 11. It has been shown that the bar width $D_1$ should be 5 to 20%, preferably 15%, of the slide bearing length L. It should be noted that the bar width $D_1$ is a minimum specification, i.e. a gear-side edge of the lubrication pocket 2 does not have to run parallel to the gear-side end face. Furthermore, it is not absolutely necessary for the lubrication pocket 2 to have the minimum bar width $D_1$.

Furthermore, the lubrication pocket 2 on the other bearing side is spaced apart from a second end face 8 (also referred to as the outer bearing side), which is located opposite the gear-side end face 7 of the slide bearing 3, by a second distance do, so that a second bar 12 is present, which has a second bar width $D_2$, whereby this in turn is smaller than the second distance do because a transition from the sliding surface of the slide bearing 3 to the second end face 8 of the slide bearing 3 is again not counted as part of the second bar 12. It has been shown that the bar width $D_2$ should be 5 to 15%, preferably 10%, of the slide bearing length L. It should also be noted here that the bar width $D_2$ is a minimum specification, i.e. a bearing outer-side edge of the lubrication pocket 2 does not have to run parallel to the bearing outer side. In addition, it is not absolutely necessary for the lubrication pocket 2 to have the minimum bar width $D_2$.

This means that a maximum axial expansion (in relation to the shaft axis) of the lubrication pocket 2 is determined by the above definitions of the first and second bars 11 and 12. A maximum expansion of the lubrication pocket 2 along the sliding surface of the slide bearing 3 will be explained below with reference to FIGS. 3 and 4.

Figure 3:
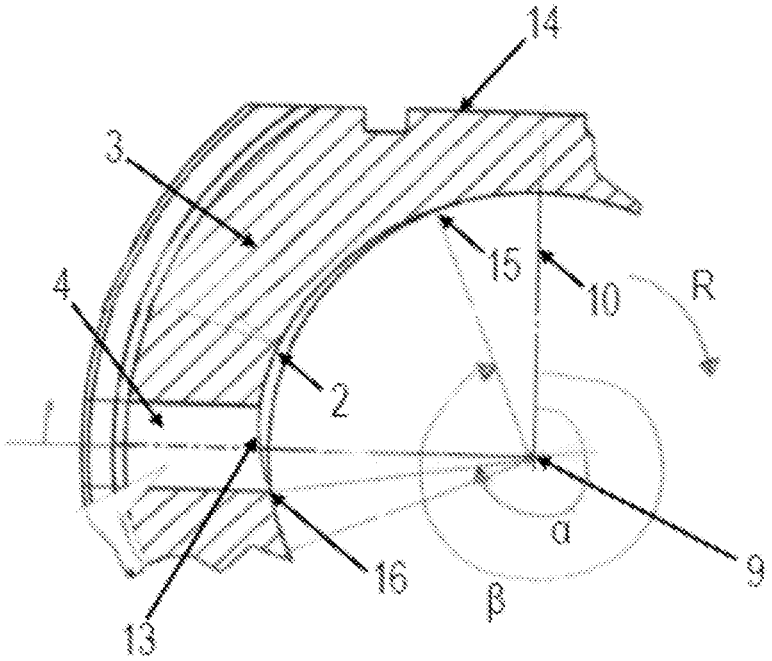

FIG. 3 shows a partial cross-section through the slide bearing 3 according to the invention in the region of the bore 4 and the associated lubrication pocket 2, the lubrication pocket 2 shown being only one of many possible embodiments of the present invention. The position of the lubrication pocket 2 is represented by an angle to a plane spanned by the two shaft axes 9, the so-called angular reference plane 10, and the angle is indicated in the direction of rotation R of the shaft in the slide bearing 3. The angular reference plane 10 is thus perpendicular to a chordal surface 14 of the slide bearing 3. The lubrication pocket 2 begins at an entry edge 16 into the lubrication pocket 2. Viewed in the direction of rotation R and in relation to the angular reference plane 10, the lubrication pocket 2 begins with the entry edge 16 after a start angle $\alpha$ and ends with the exit edge 15 after an end angle $\beta$. In the embodiment of the lubrication pocket 2 according to the invention as shown in FIG. 3, the start angle is $\alpha$=265° and the end angle is $\beta$=355°. The bore 4, through which the lubricant is fed into the lubrication pocket 2, has an injection point 13 that coincides at least partially with the leading edge 16. After the injection point 13, the lubricant is distributed both in the axial direction and in the direction of rotation R within the lubrication pocket 2 until the lubricant enters a lubrication gap at the outlet edge 15, which is formed on the one hand by the shaft or the bearing journal 5, 6 and on the other hand by the slide bearing 3 and forms a lubricant film.

Figure 4:
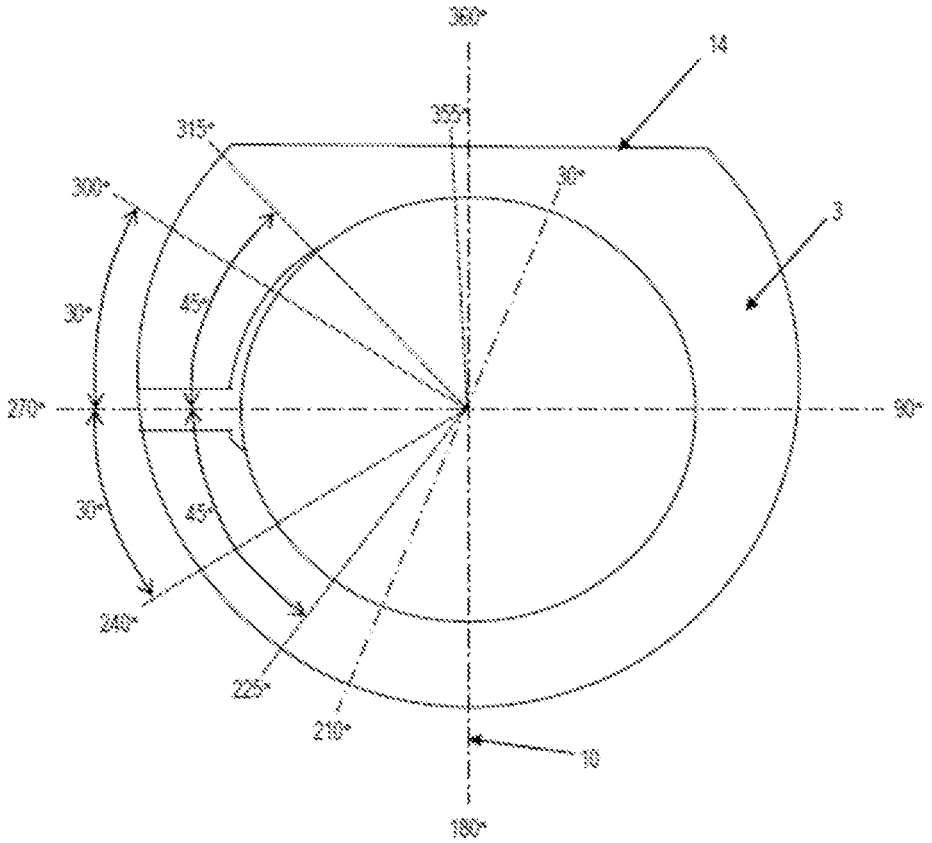

FIG. 4, which shows a section through the entire slide bearing 3 according to FIG. 3, defines the angular ranges according to the invention, within which both the start angle $\alpha$ and the end angle $\beta$ as well as the injection point 13 of the bore 4 into the lubrication pocket 2 lie. It has been shown that the lubrication pocket 2 has a minimum start angle $\alpha$ of 210° and a maximum end angle $\beta$ of 30°, meaning that such a lubrication pocket 2 covers the maximum angle range of 210° to 30°. The injection point 13 and thus one end of the bore 4 in the lubrication pocket 2 lies in an angular range of 225° to 315°, whereby, restrictively, the injection point 13 must always end in the lubrication pocket 2: In other words, the injection point 13 must necessarily be arranged after the start angle $\alpha$ and before the end angle $\beta$ of the selected lubrication pocket 2, but at the same time must also lie within the angular range of 225° to 315°. The injection point 13 is preferably located within an angular range of 240° to 300°. It has also been shown that the injection point 13 is located in particular at an injection point angle $\delta$ of 270°. For its part, the lubrication pocket 2 preferably extends over an angular range of 265° to 355°.

It follows from the above angle specifications that the injection point 13 does not necessarily have to be located directly after the start angle $\alpha$, even if this is preferably intended. Rather, it is conceivable that the injection point 13—taking into account the aforementioned conditions for the angle range for the injection point 13 and the expansion of the lubrication pocket 13—can be at any point, in particular also in the area of the end angle $\beta$.

While the position of the injection point 13 is sufficiently defined, the associated bore 4 is designed, for example, as a radial bore 4 through the slide bearing 3. However, any drilling direction through the slide bearing 3 to the injection point 13 is conceivable.

This defines a maximum frame 20—now again with a view to FIG. 2—within which the lubrication pocket 2 is located or which the lubrication pocket 2 fills to the maximum. This maximum frame 20 is shown in FIG. 2 by a dashed line.

As already briefly pointed out in connection with explanations of FIG. 2, the lubrication pocket 2 incorporated in the slide bearing 3 is supplied with a lubricating medium which is pressed into the lubrication pocket 2 through the bore 4 via the injection point 13. Viewed in the direction of rotation R of the bearing journal 5, 6, the lubrication pocket 2 can start at or in front of the injection point 13 at a minimum lubrication pocket start and end at a maximum lubrication pocket end. So while the maximum width of the lubrication pocket 2 is defined by the bar widths $D_1$ and $D_2$ as a proportion of the slide bearing length L, the maximum length of the lubrication pocket 2—viewed in the direction of rotation R of the bearing journals 5, 6—is defined by the lubrication pocket start 16 and the lubrication pocket end 15 by means of angles, which have been explained with reference to FIG. 4.

As already mentioned, the injection point 13 can be located anywhere within the maximum frame 20 (FIG. 2). Preferably, the injection point 13 is located in the center of the frame 20 and becomes steadily larger as the angle increases, as shown in the specific embodiment example for the lubrication pocket 2 in FIG. 2.

In contrast to the proven principle of bearing lubrication by means of a conveying medium, which is fed through grooves into the slide bearings according to the state of the art, a clean, low-impurity lubricating medium for lubricating film build-up is now provided by a separate external conveying device, which can be an extruder or a gear pump, for example, and pressed into the slide bearing 3. In this way, the lubricating film build-up is largely independent of the lubricating film-building properties of the conveying medium, as this task is performed by a suitable, clean and, above all, low-impurity lubricating medium. Express reference is made to the advantage that this external lubricating medium can be different from the conveying medium to build up the lubricating film. However, the lubricant must be selected in such a way that it is compatible with the lubricant, as the lubricant subsequently mixes with the pumped medium, i.e. after exiting the slide bearing gap.

According to the invention, the geometry of the slide bearing 3 and the design of the lubrication pocket 2 in the slide bearing 3 are designed in such a way that the smallest possible quantity of lubricating medium is required for the hydrodynamic slide bearings 3. At the same time, the design of the slide bearing 3 and the geometry of the lubrication pocket 2 must ensure that as little contaminated pumped medium as possible enters the slide bearing 3 from the main flow, as otherwise the good lubricating properties of the clean, externally supplied lubricant cannot be utilized. A suitable choice of geometry for the slide bearing 3 and the design of the lubrication pocket 2 ensures that the contaminated pumped medium is largely kept out of the lubrication gap of the slide bearing 3 without additional components in the gear pump itself (such as a shaft seal, etc.).

In further development of the above explanations, it is expressly pointed out that the present invention can also be used excellently for critical applications in which no foreign particles are contained in the pumped medium, but a very thin lubricating film is nevertheless desired in the slide bearing, i.e. if the pumped medium does not permit such a thin lubricating film.

Figure 5:
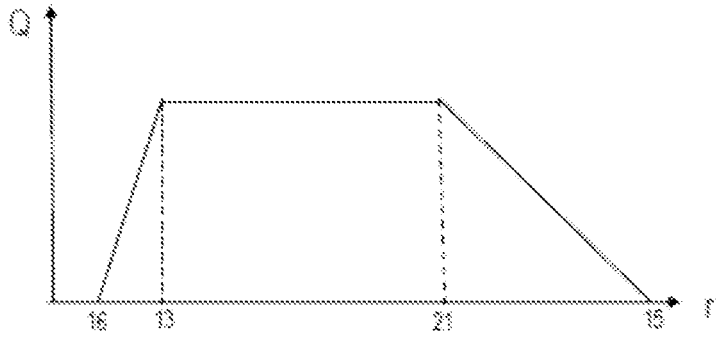

FIG. 5 shows a curve of the cross-sectional area Q as a function of an increasing angle of rotation r, starting from the starting edge 16 (FIG. 2) of the lubrication pocket 2, which widens continuously as the angle of rotation r increases. This is an embodiment variant for a lubrication pocket 2 that has a constant cross-sectional area Q over a significant extension in the direction of rotation R. Preferably, the cross-sectional area of the bore 4—and consequently also the cross-sectional area of the injection point 13—is constant over a large area of its expansion (for example, over ⅔ of the entire expansion of the lubrication pocket 2 in the direction of rotation R up to a boundary line 21). In the last third of the lubrication pocket 2 (again viewed in the direction of rotation R), the cross-sectional area Q decreases steadily, for example, up to the outlet edge 15. Due to the lubrication pocket 2 widening steadily in the direction of rotation R (see FIG. 2), a depth of the lubrication pocket 2 decreases in the first ⅔ of the expansion of the lubrication pocket 2 in the direction of rotation R in such a way that the cross-sectional area Q is constant. This achieves optimum distribution of the lubricant within the lubrication pocket 2 before the lubricant reaches or is pressed into the slide bearing gap between the shaft and slide bearing 3.

REFERENCE LIST

1 gear wheel
2 lubrication pocket
3 sliding bearing
4 bore
5,6 bearing journals
7 bearing inner side; gear-side end face; gear end face;
8 bearing outer side; end face opposite the end face on the gear side; bearing end face;
9 shaft axis
10 angle reference plane
11 first bar
12 second bar
13 injection point
14 chordal surface
15 exit edge
16 starting edge
20 maximum frame
21 boundary line
R rotation direction of the shaft
r rotation angle
α starting angle
β end angle
δ injection point angle
$D_L$ bearing journal diameter
$D_F$ base circle diameter
LG slide bearing length
Q cross-sectional area
$d_1$ first distance of the lubrication pocket from the face of the slide bearing on the gear side
$d_2$ second distance of the lubrication pocket from the opposite side to the face of the slide bearing on the gear side
$D_1$ first bar width
$D_2$ second bar width

The invention claimed is:

1. Gear pump with intermeshing gearwheels (1) enclosed by housing with bearing journals (5, 6) arranged on shaft axes (9) and each projecting laterally from the gearwheels (1), which are mounted in the housing by of slide bearings (3) each of the side bearing having a slide bearing length (L) and each having a lubrication pocket (2) with radial expansion, wherein the lubrication pocket (2) is spaced from a gear-side end face (7) of a respective slide bearing (3) by a first distance (d1), so that a first bar (11) with a first bar width ($D_1$) with axial expansion corresponding to a slide bearing surface is present, wherein:

the lubrication pocket (2) is also spaced apart from a bearing end face (8) opposite the gear-side end face (7) by a second distance (d2), so that a second bar (12) with a second bar width ($D_2$) with axial expansion corresponding to the slide bearing surface is present, a bore (4) leads through the slide bearing (3) and communicates with the lubrication pocket (2) at an injection point (13), the bore (4) is operatively connected to a conveying device for conveying lubricating medium into the lubricating pocket (2), and the injection point (13), viewed in a direction of rotation (R) of the gearwheels (1), is arranged at a beginning of the lubrication pocket (2), and the lubrication pocket (2) is deepest in a region of the injection point (13).

2. Gear pump according to claim 1, characterized in that the first bar width ($D_1$) is at least 5% to 20%, preferably 15%, of the slide bearing length (L).

3. Gear pump according to claim 1, characterized in that the second bar width ($D_2$) is at least 5% to 15%, preferably 10%, of the slide bearing length (L).

4. Gear pump according to claim 1, characterized in that the lubrication pocket (2) starts, in relation to a plane spanned by the two shaft axes (9) and in the direction of rotation (R) of the gear wheels, in an angular range of 210° to 315°, preferably at 270°.

5. Gear pump according to claim 1, characterized in that the lubrication pocket (2) ends in an angular range of 300° to 30°, preferably at 355°, in relation to a plane spanned by the two shaft axes (9) and in the direction of rotation (R) of the gear wheels (1).

6. Gear pump according to claim 1, characterized in that the injection point (13) is arranged centrally in the lubrication pocket (2) in an axial extension of the lubrication pocket (2).

7. Gear pump according to claim 1, characterized in that the injection point (13) is arranged in an angular range from 225° to 315°, preferably in an angular range from 240° to 300°, preferably at 270°, with respect to a plane spanned by the two shaft axes (9) and in the direction of rotation (R) of the gear wheels (1).

8. Gear pump according to claim 1, characterized in that the lubrication pocket (2), starting from the injection point (13) and viewed in the direction of rotation (R) of the gear wheels (1), is wider.

9. Gear pump according to claim 8, characterized in that cross-sectional areas of the lubrication pocket (2), starting from the injection point (13) and viewed in the direction of rotation (R) of the gear wheels (1), are of a same size over ⅔ of their unwound length and in that cross-sectional areas of the lubrication pocket (2) are designed to decrease continuously over a remaining unwound length to the end of the lubrication pocket (2).

10. Gear pump according to claim 9, characterized in that a cross-sectional area of the bore (4) is the same size as the cross-sectional areas of the lubricating pocket (2) in the first ⅔ of the unwound length of the lubricating pocket (2).

11. Gear pump according to claim 1, characterized in that the bore (4) is arranged radially to an outer diameter of the respective slide bearing (3).

12. Gear pump according to claim 1, characterized in that at least one of the bearing journals (5, 6) has a bearing journal diameter ($D_L$) over at least part of its axial extent which is in a range from 90% to 100% of a root circle diameter ($D_F$) of a toothing of an associated gearwheel (1).

13. Use of the gear pump according to claim 1 for conveying highly viscous pumping medium, such as polymer, with a mass percentage of inorganic fillers of more than 60% of a total mass of pumping medium.

* * * * *